US008635994B1

(12) United States Patent
Yehle

(10) Patent No.: US 8,635,994 B1
(45) Date of Patent: Jan. 28, 2014

(54) MULTILAYER COMPOSITE LIMBS FOR AN ARCHERY BOW

(75) Inventor: Craig T. Yehle, Junction City, OR (US)

(73) Assignee: BowTech, Inc., Eugene, OR (US)

( * ) Notice: Subject to any disclaimer, the term of this patent is extended or adjusted under 35 U.S.C. 154(b) by 845 days.

(21) Appl. No.: 12/581,818

(22) Filed: Oct. 19, 2009

(51) Int. Cl.
*F41B 5/00* (2006.01)

(52) U.S. Cl.
USPC ..... 124/23.1

(58) Field of Classification Search
USPC ..... 124/23.1
See application file for complete search history.

(56) References Cited

U.S. PATENT DOCUMENTS

| | | | | |
|---|---|---|---|---|
| 2,665,678 | A | 1/1954 | Bear | |
| 2,815,015 | A | 12/1957 | De Giacomo | |
| 2,894,503 | A * | 7/1959 | Pierson et al. | 124/23.1 |
| 3,492,368 | A * | 1/1970 | Coover, Jr. et al. | 525/425 |
| 3,558,423 | A * | 1/1971 | Rossetti, Jr. | 442/233 |
| 3,850,156 | A * | 11/1974 | Eicholtz | 124/23.1 |
| 4,474,851 | A * | 10/1984 | Urry | 428/373 |
| 4,712,533 | A | 12/1987 | Cruise | |
| 4,954,127 | A * | 9/1990 | Kira | 600/36 |
| 5,087,503 | A | 2/1992 | Meatto et al. | |
| 5,194,111 | A | 3/1993 | Meatto et al. | |
| 6,012,709 | A | 1/2000 | Meatto et al. | |
| 6,679,487 | B2 | 1/2004 | Meatto et al. | |
| 2004/0007223 | A1 * | 1/2004 | Adcock | 124/23.1 |
| 2007/0007689 | A1 * | 1/2007 | Pilpel | 264/239 |
| 2007/0163559 | A1 * | 7/2007 | Simonds | 124/23.1 |
| 2008/0072887 | A1 * | 3/2008 | Park | 124/23.1 |

OTHER PUBLICATIONS

M.com E-glass Fibre.*
Clemson University—nylon fiber facts.*

* cited by examiner

*Primary Examiner* — Gene Kim
*Assistant Examiner* — Amir Klayman
(74) *Attorney, Agent, or Firm* — David S. Alavi

(57) ABSTRACT

An archery bow comprises a central riser, first and second bow limbs attached to the riser, and a draw cable coupled to the bow limbs. Each bow limb comprises a multilayer composite structure having a compression layer, a tension layer, and an intermediate layer between the compression and tension layers, with the limbs arranged so that drawing the bow causes each limb to bend toward its corresponding compression layer. Each layer comprises corresponding fibers embedded in a corresponding polymer matrix. Elastic moduli of the compression and tension layers are each smaller than that of the intermediate layer. A method comprises attaching the first and second bow limbs to the riser and coupling the draw cable to the limbs. Another method can further comprise forming each bow limb by embedding the corresponding fibers of each layer in the corresponding polymer matrix, and curing the corresponding polymer matrix.

26 Claims, 4 Drawing Sheets

MULTILAYER COMPOSITE LIMBS FOR AN ARCHERY BOW

BACKGROUND

The field of the present invention relates to archery bows. In particular, multilayer composite limbs are disclosed herein for an archery bow.

Examples of conventional multilayer limbs for archery bows are disclosed in some of the following references. Examples of multilayer beams or leaf springs of somewhat analogous construction are disclosed in some other of the following references.

U.S. Pat. No. 2,665,678 entitled "Composite archery bow" issued Jan. 12, 1954 to Bear;

U.S. Pat. No. 2,815,015 entitled "Archery bow" issued Dec. 3, 1957 to De Giacomo;

U.S. Pat. No. 2,894,503 entitled "Archery bow" issued Jul. 14, 1959 to Pierson et al;

U.S. Pat. No. 4,712,533 entitled "High-speed bow limbs" issued Dec. 15, 1987 to Cruise;

U.S. Pat. No. 5,087,503 entitled "Composite constant stress beam with gradient fiber distribution" issued Feb. 11, 1992 to Meatto et al;

U.S. Pat. No. 5,194,111 entitled "Composite constant stress beam with gradient fiber distribution" issued Mar. 16, 1993 to Meatto et al;

U.S. Pat. No. 6,012,709 entitled "Hybrid leaf spring and suspension system for supporting an axle of a vehicle" issued Jan. 11, 2000 to Meatto et al; and U.S. Pat. No. 6,679,487 entitled "Hybrid leaf spring with reinforced bond lines" issued Jan. 20, 2004 to Meatto et al.

SUMMARY

An archery bow comprises a central riser, first and second bow limbs, and a draw cable. The first and second bow limbs are attached to the riser. The draw cable is coupled to the first and second bow limbs and arranged so that pulling the draw cable to draw the bow causes the first and second bow limbs to bend toward one another. Each of the first and second bow limbs comprises a multilayer composite structure having a compression layer, a tension layer, and an intermediate layer between the compression and tension layers. Each of said layers comprises corresponding fibers embedded in a corresponding polymer matrix. The first and second bow limbs are arranged on the bow so that drawing the bow causes each limb to bend toward its corresponding compression layer. The compression and tension layers each have a respective elastic modulus smaller than an elastic modulus of the intermediate layer. A method comprises attaching the first and second bow limbs to the riser and coupling the draw cable to the limbs. Another method can further comprise forming each bow limb by embedding the corresponding fibers of each layer in the corresponding polymer matrix, and curing the corresponding polymer matrix.

Objects and advantages pertaining to archery bow limbs may become apparent upon referring to the exemplary embodiments illustrated in the drawings and disclosed in the following written description or appended claims.

The embodiments shown in the Figures are exemplary, and should not be construed as limiting the scope of the present disclosure or appended claims.

DETAILED DESCRIPTION OF EMBODIMENTS

Figure 1:
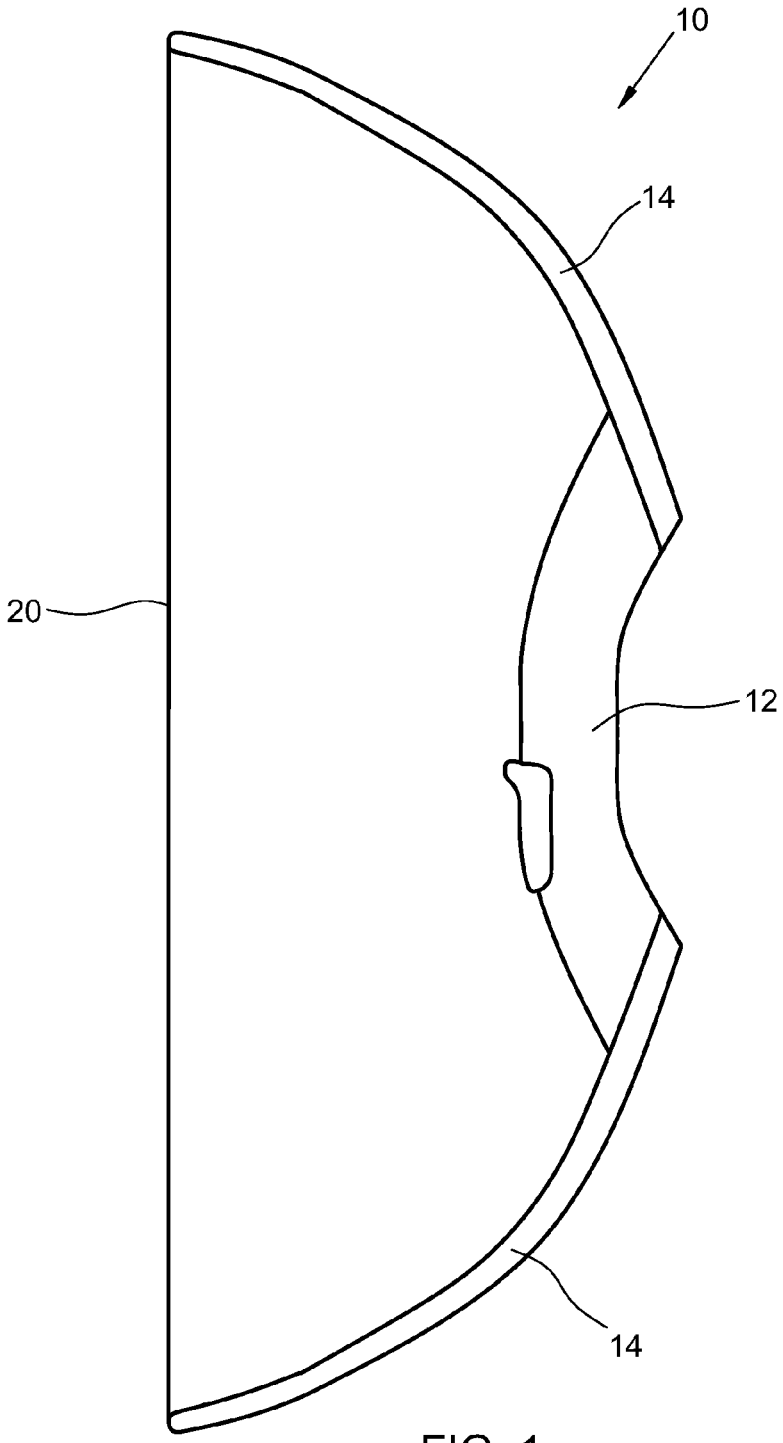
FIG. 1 is a side view of an archery bow including multilayer composite bow limbs.
Figure 2:
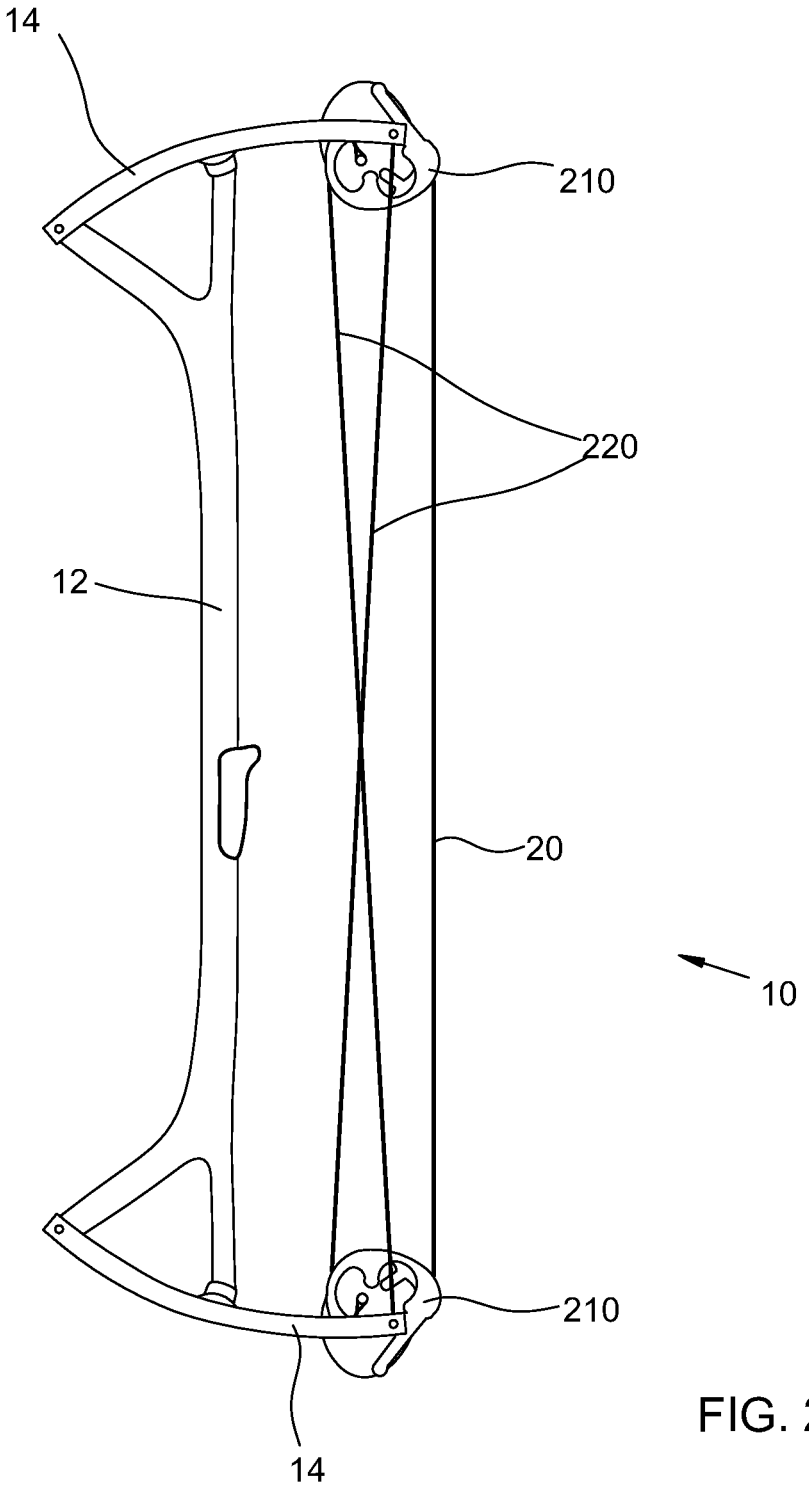
FIG. 2 is a side view of a compound archery bow including multilayer composite bow limbs.

Exemplary compound archery bows 10 are illustrated in FIGS. 1 and 2. Each comprises a central riser 12, first and second multilayer composite bow limbs 14 attached to central riser 12, and a draw cable 20 coupled to the bow limbs 14. The draw cable and bow limbs are arranged so that pulling draw cable 20 to draw the bow 10 causes the bow limbs 14 to bend toward one another. It is typically the case that bow limbs 14 are substantially identical, and that is assumed in the following description. However, the disclosed multilayer composite bow limbs also can be employed in a bow having differing limbs.

In the exemplary bow 10 of FIG. 1, the draw cable 20 is connected directly to the bow limbs 14, so that pulling the draw cable 20 to draw the bow 10 bends the bow limbs 14 toward one another. Such bows include, e.g., straight bows, long bows, recurve bows, or reflex bows, any of which can employ the multilayer composite bow limbs disclosed herein.

The exemplary bow 10 of FIG. 2 is a compound bow, which includes first and second pulley members 210 rotatably mounted on the bow limbs 14. The pulley members 210 are arranged to couple the draw cable 20 to the bow limbs 14. As the bow 10 is drawn the pulley members 210 rotate and let out the draw cable 20. The compound bow includes at least one additional cable 220 coupled to the bow limbs 14 and arranged to be taken up or let out by at least one of the pulley members 210 as the bow 10 is drawn. The exemplary compound bow of FIG. 2 is a dual cam bow, in which two additional cables 220 are employed, each connected directly to one bow limb 14 and arranged to be taken up by the pulley member 210 on the other bow limb 14. As the bow 10 is drawn and the pulley members 210 rotate, the take-up of the additional cables 220 bends the bow limbs 14 toward one another. Any type of compound bow (e.g., dual cam, single cam, binary cam, or hybrid cam) can employ the multilayer composite bow limbs disclosed herein.

Figure 3:
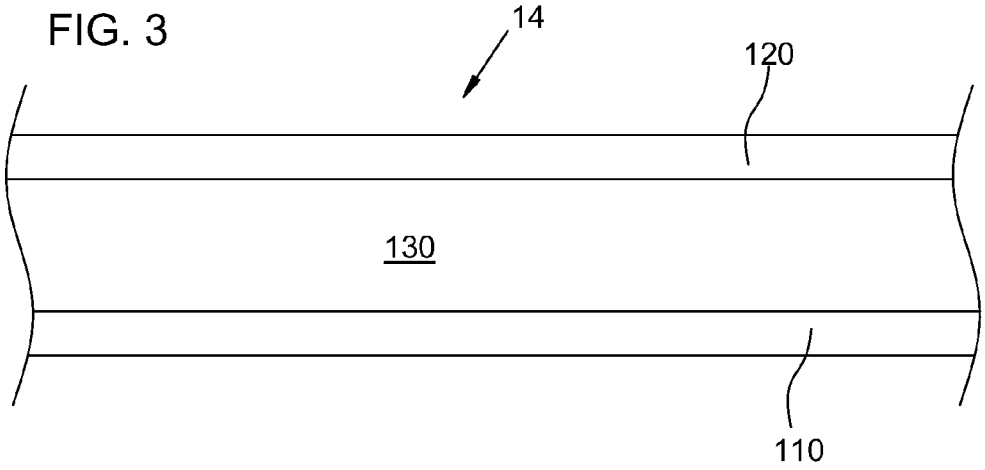
FIG. 3 is a side view of an exemplary multilayer composite bow limb.

As shown in the example of FIG. 3 (a side view), each bow limb 14 comprises a multilayer composite structure having a compression layer 110, a tension layer 120, and an intermediate layer 130 between the compression and tension layers 110 and 120. Each of those layers comprises corresponding fibers embedded in a corresponding polymer matrix. Carbon fibers of any suitable type (e.g., graphitic, turbostratic, or nanotubes), glass fibers of any suitable type, boron fibers of any suitable type, polymer fibers of any suitable type, or other suitable fibers can be employed. The polymer matrix can comprise any suitable epoxy, polyester, nylon, vinyl ester, or other polymer. The bow limbs 14 are arranged on the bow 10 so that drawing the bow causes each limb 14 to bend toward its corresponding compression layer 110 (e.g., the bow limbs 14 are arranged so that the respective compression layers 110 face one another or face backward). The elastic modulus of the intermediate layer 130 is larger than the respective elastic moduli of the compression layer 110 and the tension layer 120

(i.e., intermediate layer 130 is stiffer than tension layer 120 or compression layer 110). Although the exemplary bow limb 14 of FIG. 3 is straight, a multilayer composite bow limb according to the present disclosure can be formed in any desirable shape, e.g., a straight segment, a single curve (like a "C"), a double curve (like an "S"), or a more complex curve. The bow limb 14 can assume one shape when free from external forces, another shape when incorporated into a strung archery bow in its undrawn state (i.e., at brace), and yet another shape when the bow is drawn.

When a bow limb bends as a bow is drawn, strain energy is stored in the bent limb. The strain imposed by bending the bow limb is tensile on one surface of the limb and compressive on the opposite surface of the limb; there is a surface within the limb (referred to as the neutral surface) along which there is no compressive or tensile strain. The strain energy density of the bent bow limb is therefore concentrated at the limb surfaces, particularly if the limb has a substantially uniform elastic modulus.

The multilayer composite bow limb 14 is constructed so that the elastic modulus is larger in the intermediate layer 130 than in the compression layer 110 or the tension layer 120. The distribution of strain energy is therefore shifted away from the limb surfaces and toward the intermediate layer 130. That shift can enable a variety adaptations of the multilayer composite bow limb's characteristics to achieve differing performance goals. In one example, using a stiffer (i.e., higher modulus) material for intermediate layer 130 can enable larger overall strain energy to be stored for a given amount of bending of the bow limb, without increasing the strain at the surfaces of the limb (and the corresponding increased likelihood of structural failure of the limb at one of its surfaces). Conversely, a given overall amount of strain energy can be stored while reducing the strain at the surfaces of the limb. In another example, multilayer limbs that are smaller (e.g., thinner or shorter) than single-modulus limbs can be employed to store the same overall strain energy without commensurately increasing surface strain. Conversely, more overall strain energy can be stored without increasing the size of the limb or the strain energy at the limb surfaces. Smaller limbs offer various advantages, e.g., less mass and inertia, better dynamic response, higher natural resonance frequencies, or more readily achieved vibrational damping.

In an example of a multilayer composite bow limb 14, the following elastic moduli of the layers can be employed (1 Mpsi≡$10^6$ pounds per square inch). The elastic modulus of the compression layer 110 can typically be between about 3 Mpsi and about 10 Mpsi, preferably between about 4.5 Mpsi and about 7 Mpsi; the elastic modulus of the intermediate layer 130 can typically be between about 6 Mpsi and about 25 Mpsi, preferably between about 6 Mpsi and about 15 Mpsi; the elastic modulus of the tension layer 120 can typically be between about 3 Mpsi and about 10 Mpsi, preferably, between about 4.5 Mpsi and about 7 Mpsi.

In some examples of multilayer composite bow limbs 14, differing fibers or differing polymer matrix materials can be employed among the compression (110), intermediate (130), and tension (120) layers. For example, carbon fibers can be employed in the intermediate layer 130, while glass fibers can be employed in the compression layer 110 and the tension layer 120, with all three layers including epoxy polymer matrix material. Any suitable matrix material can be employed. Examples include but are not limited to epoxies, polyurethanes, polyesters, or polyvinyl esters. The carbon fiber intermediate layer 130 exhibits a larger elastic modulus (i.e., greater stiffness) than the glass fiber compression and tension layers 110 and 120. Any suitable fiber material can be employed. Examples include but are not limited to boron fiber, aramid fiber, polyester fiber, silica fiber, basalt fiber, liquid crystal polymer fiber, glass fiber, carbon fiber, or nanotubes. Instead of, or in addition to, employing differing fiber materials among the three layers of bow limb 14, differing polymer matrix materials can be employed among the three layers of bow limb 14. Any suitable combination of fiber material and/or polymer matrix material can be employed to achieve a desired combination of elastic moduli among the compression, intermediate, and tension layers of the multilayer composite bow limb 14.

In other examples of multilayer composite bow limbs 14, the differing elastic moduli of the compression, tension, and intermediate layers can be achieved by employing the same fiber material and polymer matrix material in all three layers, but employing a weight percentage of the fibers in the composite material of the intermediate layer 130 that is higher than that of the compression or tension layers 110 or 120. The higher weight percent of fibers in the intermediate layer 130 yields a corresponding elastic modulus of the intermediate layer 130 that is larger than that of the compression or tension layers 110 or 120. Differing weight percent of fibers can be combined with differing matrix materials or differing fiber materials.

In another example of a multilayer composite bow limb 14, the following compositions of the layers can be employed. The weight percent of fibers in the compression layer 110 can typically be between about 40% and about 75%, preferably between about 65% and about 75%; the weight percent of fibers in the intermediate layer 130 can typically be between about 40% and about 85%, preferably between about 55% and about 65%; the weight percent of fibers in the tension layer can typically be between about 40% and about 75%, preferably between about 65% and about 75%.

In another example of a multilayer composite bow limb 14, the following thicknesses of the layers can be employed over at least an intermediate portion of the length of each bow limb. The compression layer 110 can typically be between about 0.03 inches thick and about 0.15 inches thick; the intermediate layer 130 can typically be between about 0.03 inches thick and about 0.50 inches thick; the tension layer 120 can typically be between about 0.03 inches thick and about 0.15 inches thick.

In a particular example, compression layer 110 comprises about 70% glass fibers in an epoxy matrix (modulus of about 5.8 Mpsi) about 0.12 inches thick, intermediate layer 130 comprises about 60% carbon fibers in an epoxy matrix (modulus of about 14 Mpsi) about 0.06 inches thick, and tension layer 120 comprises about 70% glass fibers in an epoxy matrix (modulus of about 6.8 Mpsi) about 0.04 inches thick. In this example the intermediate layer 130 increases in thickness to about 0.17 inches at the riser end of the limb 14 and to about 0.25 inches at the cable end of the limb 14. The increased thickness accommodates attachment of limb 14 to the riser 12 and attachment of draw cable 20 to bow limb 14 (directly or using a pulley member rotatably mounted on limb 14). Any suitable, necessary, or desired thicknesses of the layers 110/120/130, or any suitable, necessary, or desired variation of those thicknesses along the length of limb 14, can be employed.

Figure 4:
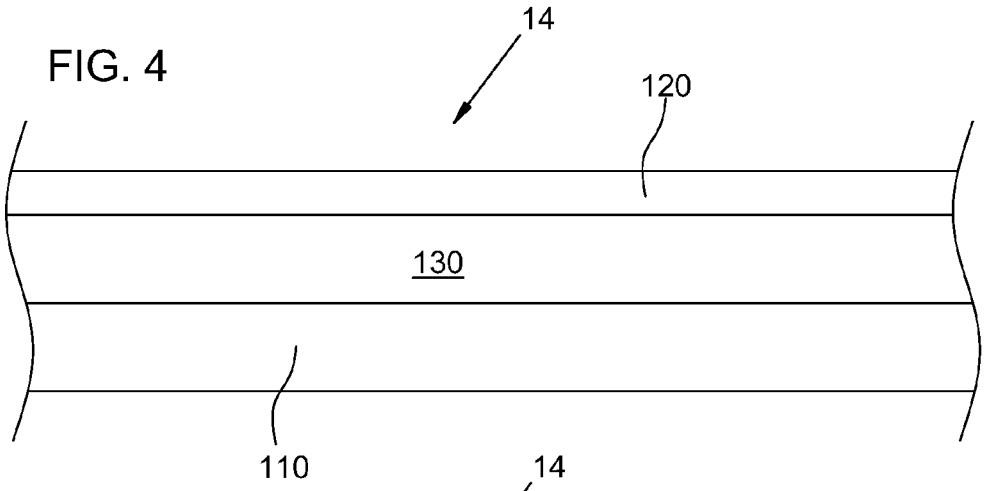
FIG. 4 is a side view of an exemplary multilayer composite bow limb.

In some examples of a multilayer composite bow limb 14, over at least an intermediate portion of the length of each bow limb, the compression layer 120 and the tension layer 120 have the same elastic modulus and have the same thickness (as in FIG. 3), so that strain energy is distributed substantially symmetrically between opposing surfaces of the bow limb 14. In other examples of a multilayer composite bow limb 14, the elastic modulus or the thickness or both can differ between the compression layer 110 and the tension layer 120, shifting strain energy distribution toward one surface or the other. For example, a thicker compression layer can be employed to shift the stiffer intermediate layer away from the bow limb surface under compression and toward the bow limb surface under tension (FIG. 4). Such an arrangement can be advantageous, for example, if the composite material of the intermediate layer is more liable to failure under compression than under tension (as is typically the case with carbon fiber composite materials, for example).

Figure 5:
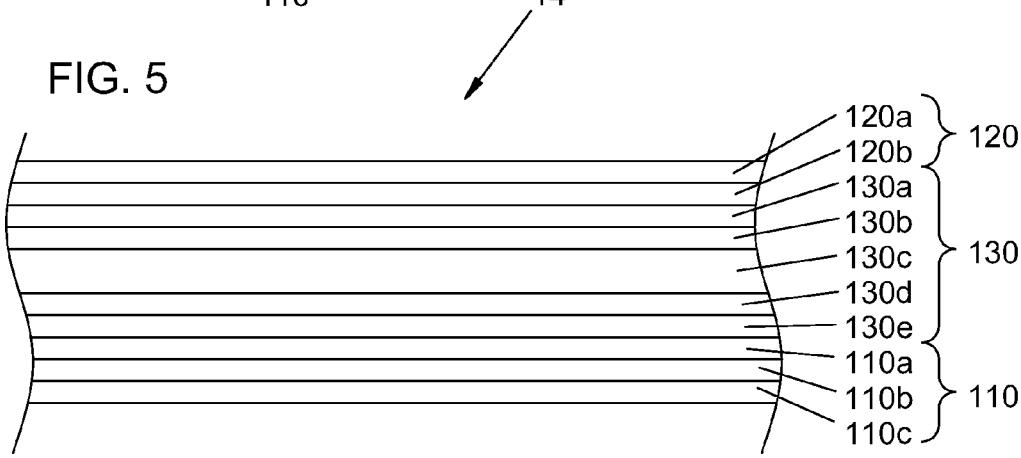
FIG. 5 is a side view of an exemplary multilayer composite bow limb.

In other examples of a multilayer composite bow limb 14, any one or more of the compression, tension, or intermediate layers 110, 120, or 130 can itself comprise multiple sublayers having differing elastic moduli. In the example of FIG. 5, compression layer 110 comprises three sublayers 110*a/b/c*, tension layer 120 comprises two sublayers 120*a/b*, and intermediate layer 130 comprises five sublayers 130*a/b/c/d/e*. Such arrangements enable more complex tailoring of the elastic modulus profile as a function of depth within the bow limb to achieve a desired strain energy distribution through the thickness of the bow limb when it is bent. The characterization of any particular sublayer as belonging to a particular layer 110, 120, or 130 can in some instances be somewhat arbitrary.

Figure 6A:
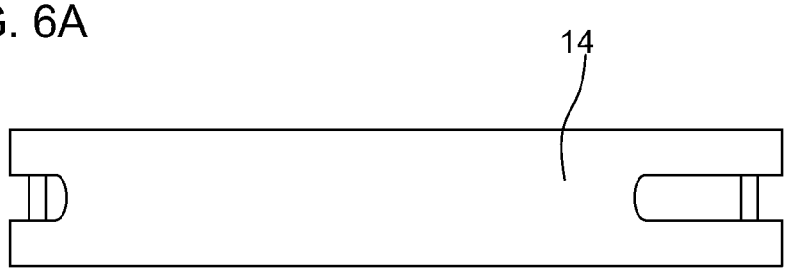
FIGS. 6A and 6B are top views of exemplary multilayer composite bow limbs.
Figure 6B:
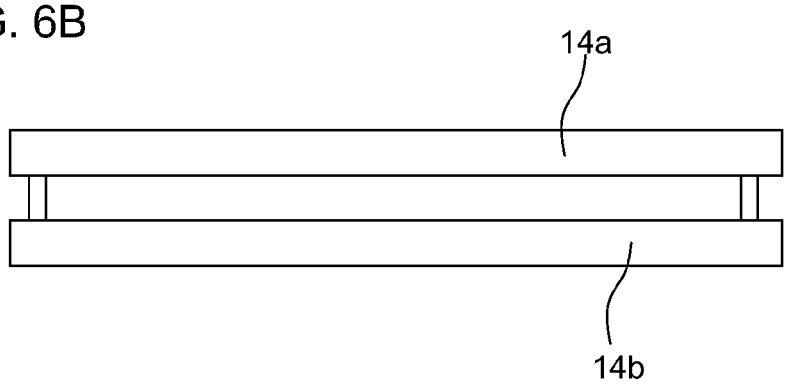

Each multilayer composite bow limb 14 can comprise a single limb member (as in the top view of FIG. 6A), or can comprise a pair of limb members 14*a/b* arranged side-by-side (as in the top view of FIG. 6B). In either case, each member comprises compression layer 110, intermediate layer 130, and tension layer 120 arranged as shown in FIGS. 3-5.

A method for constructing an archery bow comprises attaching the bow limbs 14 to the riser 12, and coupling the draw cable 20 to the bow limbs 14 in any of the arrangements described above.

The method can further comprise forming each bow limb by embedding the corresponding fibers of each layer or sublayer in the corresponding polymer matrix, and curing the corresponding polymer matrix. In some exemplary methods, fibers can be embedded in the corresponding polymer matrix material for each of the multiple layers or sublayers, those layers or sublayers can be arranged in any of the ways described above, and the polymer matrix material of each of those layers or sublayers can then be cured simultaneously. In other exemplary embodiments, each layer or sublayer can individually have its polymer matrix material cured with its fibers embedded therein, and the layers or sublayers thus formed can then be secured together using an appropriate adhesive or bonding agent. In still other exemplary methods, a combination of the foregoing methods can be employed, with some sets of layers or sublayers cured together and then adhered or bonded to other layers, sublayers, or sets thereof.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or", "only one of . . . ", or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof shall be construed as open ended terminology, with the same meaning as if the phrase "at least" were appended after each instance thereof.

In the appended claims, if the provisions of 35 USC §112 ¶ 6 are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112 ¶ 6 are not intended to be invoked for that claim.

What is claimed is:

1. An archery bow comprising:

a central riser;

first and second bow limbs attached to the riser; and a draw cable coupled to the first and second bow limbs, the bow limbs and draw cable being arranged so that pulling the draw cable to draw the bow causes the first and second bow limbs to bend toward one another, wherein:

each of the first and second bow limbs comprises a multilayer composite structure having a compression layer, a tension layer, and an intermediate layer between the compression and tension layers, each of said layers comprising corresponding fibers embedded in a corresponding polymer matrix;

the first and second bow limbs are arranged on the bow so that drawing the bow causes each limb to bend toward its corresponding compression layer; and the compression and tension layers each have a respective elastic modulus smaller than an elastic modulus of the intermediate layer; and wherein: the compression layer comprises multiple sublayers having differing elastic moduli; the intermediate layer comprises multiple sublayers having differing elastic moduli; or the tension layer comprises multiple sublayers having differing elastic moduli.

2. The bow of claim 1 further comprising:

first and second pulley members rotatably mounted on the first and second bow limbs, respectively, the pulley members being arranged to couple the draw cable to the first and second bow limbs and to rotate and let out the draw cable as the bow is drawn; and at least one additional cable coupled to the first and second bow limbs and arranged to be taken up or let out by at least one of the pulley members as the bow is drawn.

3. The bow of claim 1 wherein each bow limb comprises a pair of limb members arranged side-by-side.

4. The bow of claim 1 wherein the fibers of the intermediate layer comprise a material that differs from that of the fibers of the compression layer or the fibers of the tension layer.

5. The bow of claim 1 wherein:

the polymer matrix of the compression layer comprises epoxy, polyurethane, polyester, or polyvinyl ester;

the polymer matrix of the intermediate layer comprises epoxy, polyurethane, polyester, or polyvinyl ester; and the polymer matrix of the tension layer comprises epoxy, polyurethane, polyester, or polyvinyl ester.

6. The bow of claim 1 wherein:

the fibers of the compression layer comprise boron, aramid, polyester, silica, basalt, liquid crystal polymer, glass, carbon, or nanotubes;

the fibers of the intermediate layer comprise boron, aramid, polyester, silica, basalt, liquid crystal polymer, glass, carbon, or nanotubes; and the fibers of the tension layer comprise boron, aramid, polyester, silica, basalt, liquid crystal polymer, glass, carbon, or nanotubes.

7. The bow of claim 1 wherein the compressive layer includes glass fibers, the intermediate layer includes graphite fibers, and the tension layer includes glass fibers.

8. The bow of claim 7 wherein:

a weight percent of fibers in the compression layer is between about 40% and about 75%;

a weight percent of fibers in the intermediate layer is between about 40% and about 85%; and a weight percent of fibers in the tension layer is between about 40% and about 75%.

9. The bow of claim 7 wherein the compression layer includes epoxy polymer matrix, the intermediate layer includes epoxy polymer matrix, and the tension layer includes epoxy polymer matrix.

10. The bow of claim 7 wherein, over at least an intermediate portion of the length of each bow limb:

the compression layer is between about 0.03 inches thick and about 0.15 inches thick;

the intermediate layer is between about 0.03 inches thick and about 0.50 inches thick; and the tension layer is between about 0.03 inches thick and about 0.15 inches thick.

11. The bow of claim 7 wherein:

the elastic modulus of the compression layer is between about 3 Mpsi and about 10 Mpsi;

the elastic modulus of the intermediate layer is between about 6 Mpsi and about 25 Mpsi; and the elastic modulus of the tension layer is between about 3 Mpsi and about 10 Mpsi.

12. The bow of claim 7 wherein, over at least an intermediate portion of the length of each bow limb, the compression layer is thicker than the tension layer.

13. A method for constructing an archery bow, the method comprising:

attaching first and second bow limbs to a central riser; and coupling a draw cable to the first and second bow limbs and arranging the bow limbs and draw cable so that pulling the draw cable to draw the bow causes the first and second bow limbs to bend toward one another, wherein:

each of the first and second bow limbs comprises a multilayer composite structure having a compression layer, a tension layer, and an intermediate layer between the compression and tension layers, each of said layers comprising corresponding fibers embedded in a corresponding polymer matrix;

the first and second bow limbs are arranged on the bow so that drawing the bow causes each limb to bend toward its corresponding compression layer; and the compression and tension layers each have a respective elastic modulus smaller than an elastic modulus of the intermediate layer; and wherein: the compression layer comprises multiple sublayers having differing elastic moduli; the intermediate layer comprises multiple sublayers having differing elastic moduli; or the tension layer comprises multiple sublayers having differing elastic moduli.

14. The method of claim 13 further comprising forming each bow limb by:

embedding the corresponding fibers of each layer in the corresponding polymer matrix; and curing the corresponding polymer matrix.

15. The method of claim 14 further comprising assembling the compression layer, the intermediate layer, and the tension layer before curing the corresponding polymer matrices.

16. The method of claim 13 further comprising:

rotatably mounting first and second pulley members on the first and second bow limbs, respectively, and arranging the pulley members to couple the draw cable to the first and second bow limbs and to rotate and let out the draw cable as the bow is drawn; and coupling at least one additional cable to the first and second bow limbs and arranging each additional cable to be taken up or let out by at least one of the pulley members as the bow is drawn.

17. The method of claim 13 wherein each bow limb comprises a pair of limb members arranged side-by-side.

18. The method of claim 13 wherein the fibers of the intermediate layer comprise a material that differs from that of the fibers of the compression layer or the tension layer.

19. The method of claim 13 wherein:

the polymer matrix of the compression layer comprises epoxy, polyurethane, polyester, or polyvinyl ester;

the polymer matrix of the intermediate layer comprises epoxy, polyurethane, polyester, or polyvinyl ester; and the polymer matrix of the tension layer comprises epoxy, polyurethane, polyester, or polyvinyl ester.

20. The method of claim 13 wherein:

the fibers of the compression layer comprise boron, aramid, polyester, silica, basalt, liquid crystal polymer, glass, carbon, or nanotubes;

the fibers of the intermediate layer comprise boron, aramid, polyester, silica, basalt, liquid crystal polymer, glass, carbon, or nanotubes; and the fibers of the tension layer comprise boron, aramid, polyester, silica, basalt, liquid crystal polymer, glass, carbon, or nanotubes.

21. The method of claim 13 wherein the compressive layer includes glass fibers, the intermediate layer includes graphite fibers, and the tension layer includes glass fibers.

22. The method of claim 21 wherein:

a weight percent of fibers in the compression layer is between about 40% and about 75%;

a weight percent of fibers in the intermediate layer is between about 40% and about 85%; and a weight percent of fibers in the tension layer is between about 40% and about 75%.

23. The method of claim 21 wherein the compression layer includes epoxy polymer matrix, the intermediate layer includes epoxy polymer matrix, and the tension layer includes epoxy polymer matrix.

24. The method of claim 21 wherein, over at least an intermediate portion of the length of each bow limb:

the compression layer is between about 0.03 inches thick and about 0.15 inches thick;

the intermediate layer is between about 0.03 inches thick and about 0.50 inches thick; and the tension layer is between about 0.03 inches thick and about 0.15 inches thick.

25. The method of claim 21 wherein:

the elastic modulus of the compression layer is between about 3 Mpsi and about 10 Mpsi;

the elastic modulus of the intermediate layer is between about 6 Mpsi and about 25 Mpsi; and the elastic modulus of the tension layer is between about 3 Mpsi and about 10 Mpsi.

26. The method of claim 21 wherein, over at least an intermediate portion of the length of each bow limb, the compression layer is thicker than the tension layer.

* * * * *